US005802900A

United States Patent [19]

Lee

[11] Patent Number: 5,802,900

[45] Date of Patent: Sep. 8, 1998

[54] APPARATUS FOR FABRICATING A FLUID BEARING

[75] Inventor: Sung-hee Lee, Suwon, Rep. of Korea

[73] Assignee: Samsung Electronics Co., Ltd., Rep. of Korea

[21] Appl. No.: 859,573

[22] Filed: May 20, 1997

Related U.S. Application Data

[63] Continuation of Ser. No. 435,815, May 5, 1995, abandoned.

[51] Int. Cl.[6] ..... H21D 17/04

[52] U.S. Cl. ..... 72/75

[58] Field of Search ..... 72/75, 117, 119, 72/126

[56] References Cited

U.S. PATENT DOCUMENTS

| | | | |
|---|---|---|---|
| 743,287 | 11/1903 | Hunker | 72/75 |
| 1,638,422 | 8/1927 | Walker | 72/75 |
| 1,907,038 | 5/1933 | Burns | 72/75 |

FOREIGN PATENT DOCUMENTS

| | | | |
|---|---|---|---|
| 926748 | 5/1973 | Canada | 72/75 |
| 001345 | 5/1965 | United Kingdom | 72/126 |

*Primary Examiner*—Lowell A. Larson
*Attorney, Agent, or Firm*—Burns, Doane, Swecker & Mathis LLP

[57] ABSTRACT

In an apparatus for fabricating a fluid bearing having a dynamic-pressure-generating track slot installed in the internal diametric surface of a sleeve, a ball-escape-preventing device is coupled with a rotary shaft being in contact with one end thereof so as to form the identical outer diametric surface with that of the rotary shaft to support the ball. Therefore, it is not necessary to control the angular velocity and axial transfer velocity of a guide bushing or ring with respect to those of the rotary shaft. Also, a fluid bearing of a high precision and high efficiency can be fabricated with an inexpensive and simple device by which ball wear due to rolling can be reduced and the ball is easily replaced when worn.

1 Claim, 1 Drawing Sheet

APPARATUS FOR FABRICATING A FLUID BEARING

This application is a continuation of Application No. 08/435,815 filed May 5, 1995, now abandoned.

BACKGROUND OF THE INVENTION

The present invention relates to an apparatus for fabricating a fluid bearing having a dynamic-pressure-generating track slot installed in the internal diametric surface of a sleeve.

Known methods for processing a dynamic-pressure-generating track slot largely include a cutting process using a cutting tool and a heating process using a hard ball and roller. While the cutting process has an extremely low productivity, the heating process exhibits high precision and high efficiency. Thus, the latter method has been more widely adopted.

FIG. 1 shows a conventional method for fabricating a dynamic-pressure-generating track slot for a fluid bearing by the above heating process using a ball, and the apparatus thereof. In the structure of the conventional apparatus, a guide bushing 12 is wrapped around a hard rotary pin 11 having a track slot 16, and a hard ball 14 having a predetermined diameter and protruding a predetermined height to form dynamic-pressure-generating track slots 13 is positioned within the track slot 16.

Now, a method of forming dynamic-pressure-generating track slots 13 for a fluid bearing using the aforementioned apparatus will be described.

First, the apparatus is housed in the inner diametric surface of a sleeve 15 made of a comparatively soft working base metal and supported by a fixed tool (not shown). Thereafter, while the rotary pin 11 supported by predetermined supporting means (not shown) concentrically with the sleeve 15 is rotated at an angular velocity $W_p$ and transferred at an axial transfer velocity $V_p$, the guide bushing 12 is rotated at an angular velocity $W_k$ and transferred at an axial transfer velocity $V_k$. Through this process, dynamic-pressure-generating track slots 13 are formed in the inner diametric surface of the sleeve 15 by a heating method.

However, according to the conventional apparatus for fabricating a fluid bearing, since the angular velocity and transfer velocity $W_k$ and $V_k$ of the guide bushing 12 as well as the angular velocity and transfer velocity $W_p$ and $V_p$ of the rotary pin 11 should be controlled, overall control is hard to accomplish and thus the system becomes costly and complicated. Also, since it is difficult to replace a worn-out ball, high precision processing is hard to attain.

SUMMARY OF THE INVENTION

To solve the problems of the prior art, it is, therefore, an object of the present invention to provide an apparatus for fabricating a fluid bearing whereby a dynamic-pressure-generating track slot can be fabricated in the inner diametric surface of a sleeve with an inexpensive and simple device by which a worn-out ball can be easily replaced.

To accomplish the above object, there is provided a apparatus for fabricating the fluid bearing according to the present invention wherein a ball-accepting guide groove having a hard ball protruding a predetermined height is provided at the leading edge of a rotary shaft and a ball-escape-preventing device for preventing the hard ball from escaping in the direction of rotary shaft is coupled at the leading edge of the rotary shaft.

According to the present invention, the rotary shaft is preferably provided with locking means which can connect the ball-escape-preventing device with the center of one side thereof. The locking means is more preferably made of a threaded slot.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
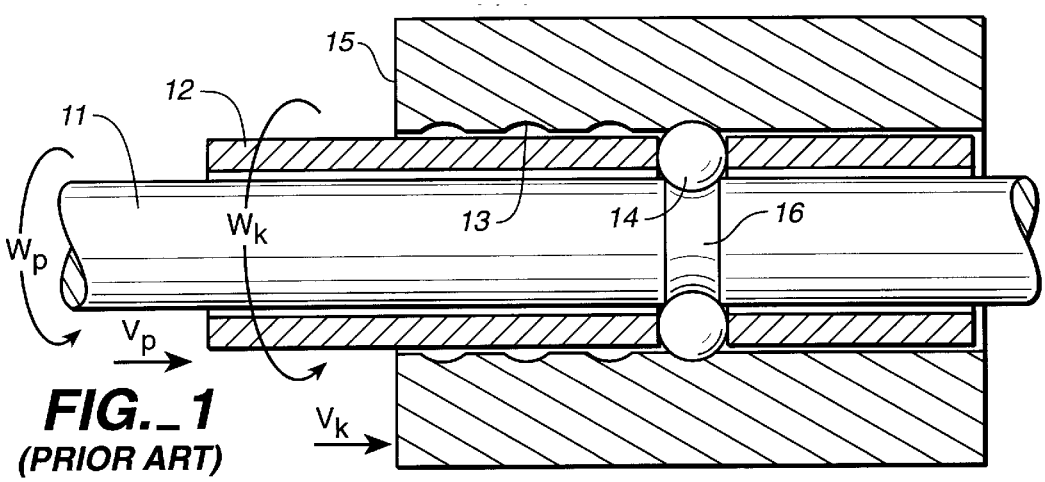
FIG. 1 (PRIOR ART)
FIG. 1 is an axial cross-sectional view of a conventional apparatus for fabricating a fluid bearing.
Figure 2:
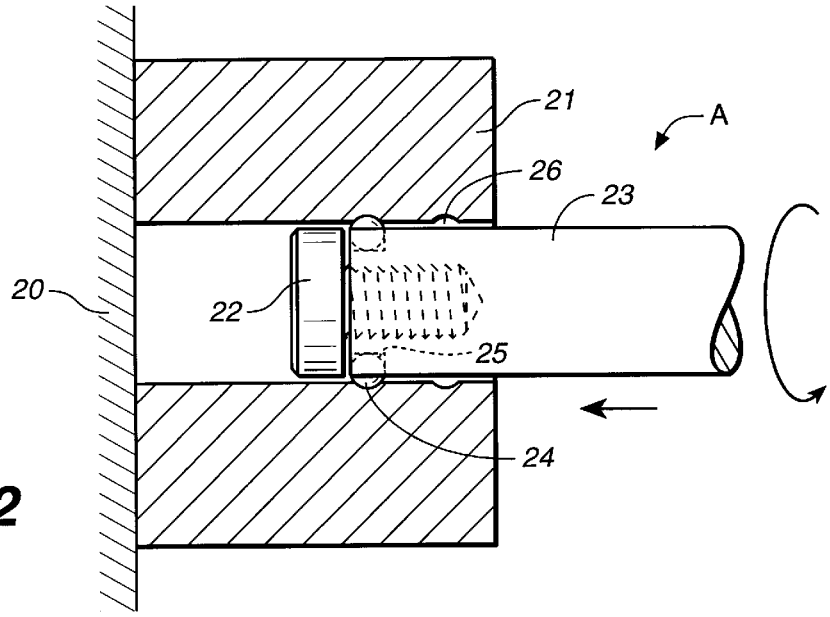
FIG. 2 is an axial cross-sectional view of an apparatus for fabricating a fluid bearing, according to the present invention.
Figure 3:
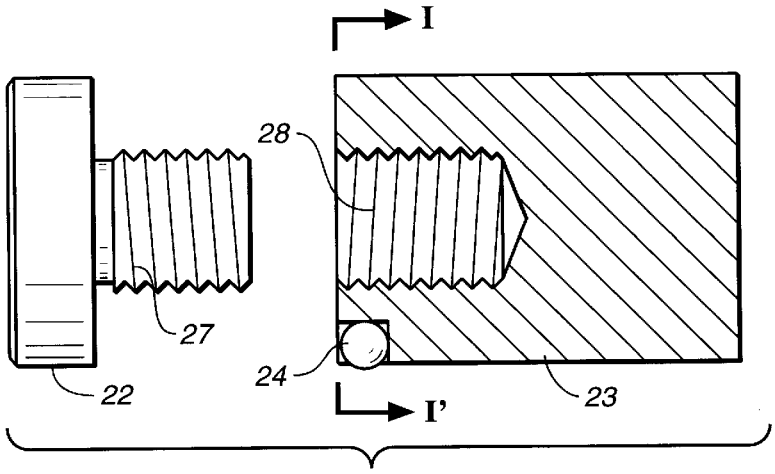
FIG. 3 is a detailed diagram of a tool (A) shown in FIG. 2.
Figure 4:
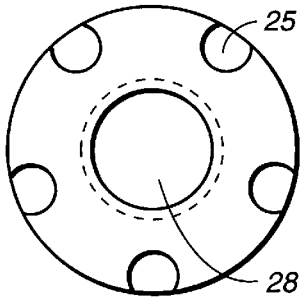
FIG. 4 is a cross-sectional view of the tool (A), taken along line I–I' of FIG. 3.

In FIGS. 2 to 4, reference numeral 21 is a sleeve made of a working base metal, reference numeral 22 is a ball-escape-preventing device, reference numeral 23 is a rotary shaft, reference numeral 25 is a guide groove, and reference numeral 24 is a ball inserted into the guide groove.

Referring to FIGS. 2 to 4, a locking slot 28 is provided in the center of one side of the rotary shaft supported by a predetermined supporting means. In the rim of the locking slot 28, there are provided a plurality of guide grooves 25 so as to be spread over the outer diametric surface of the rotary shaft 23. In the guide grooves 25, a plurality of balls 24 are supported so that the surface is partially projected toward the outer diametric surface of the rotary shaft 23, thereby being driven freely. Also, ball-escape-preventing device 22 having a projected bracket bolt 27 coupled with the locking slot 28 of the rotary shaft 23 contacts with one side of the rotary shaft and supports the ball 24. That is to say, the ball-escape-preventing device 22 connects the ball 24 with the rotary shaft 23 so that the rotary shaft 23 and the ball 24 supported by the ball-escape-preventing device 22 are housed within the inner diametric surface of the sleeve 21 such that a tool (A) integrally coupled with the rotary shaft 23 is inserted into the inner diametric surface of the sleeve 21 made of a soft working base metal.

Then, the rotary shaft 23 of the tool (A) supported by a predetermined supporting means (not shown) is rotated and axially transferred at a constant velocity, thereby rolling the ball 24 driven between the rotary shaft 23 and sleeve 21 and finally forming a dynamic-pressure-generating track slot 26 on the inner diametric surface of the sleeve 21 by a heating process.

As described above, according to the apparatus for fabricating a fluid bearing of the present invention, differently from the conventional apparatus where a guide bushing or ring is inserted between the rotary shaft and sleeve, a ball-escape-preventing device is coupled therewith, being in contact with one end of the rotary shaft so as to form the identical outer diametric surface with that of the rotary shaft to support the ball. Therefore, it is not necessary to control the angular velocity and axial transfer velocity of the guide bushing or ring with respect to those of the rotary shaft. Also, a fluid bearing of a high precision and high efficiency can be fabricated with an inexpensive and simple device by which ball wear due to rolling can be reduced and the ball is easily replaced when worn.

What is claimed is:

1. An apparatus for fabricating a fluid bearing comprising a rotary shaft, a ball-accepting cylindrical guide groove with an end portion open to a leading edge surface of the rotary shaft for accepting a hard ball projected in a predetermined radial distance beyond an outer surface of the rotary shaft provided at the leading edge of said rotary shaft;

a ball-escape-preventing device having substantially the same outer diameter as an outer diameter of the rotary shaft and a substantially planar surface enclosing the end portion of the ball-accepting cylindrical guide groove for preventing said hard ball from escaping in the axial direction of said rotary shaft, which said ball-escape-preventing device is coupled at said leading edge of said rotary shaft and the hard ball has a contacting surface which projects a predetermined height beyond the outer diameter of the ball-escape-preventing device with a predetermined diameter in a perpendicular radial direction with respect to a longitudinal axis of the rotary shaft to produce a force perpendicular to the longitudinal axis; and a locking means for connecting said ball-escape-preventing device to the center of said rotary shaft for preventing said hard ball from escaping with rotation of said rotary shaft, said locking means including a threaded slot formed within the end of said rotary shaft.

* * * * *